US007388499B2

(12) United States Patent
Hayashi et al.

(10) Patent No.: US 7,388,499 B2
(45) Date of Patent: Jun. 17, 2008

(54) ELECTRONIC TAG AUTHENTICATION DEVICE AND COMMUNICATION ADJUSTMENT METHOD WITH ELECTRONIC TAG

(75) Inventors: Hiroyuki Hayashi, Kawasaki (JP); Toru Maniwa, Kawasaki (JP); Andrey Andrenko, Kawasaki (JP); Manabu Kai, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 250 days.

(21) Appl. No.: 10/995,661

(22) Filed: Nov. 23, 2004

(65) Prior Publication Data

US 2006/0022884 A1 Feb. 2, 2006

(30) Foreign Application Priority Data

Jul. 30, 2004 (JP) ..... 2004-223388

(51) Int. Cl.
*G08B 13/14* (2006.01)

(52) U.S. Cl. ..... 340/572.7; 340/10.1; 340/10.3; 340/572.4; 342/432; 342/450; 343/853

(58) Field of Classification Search ..... 340/572.7, 340/572.8, 572.1, 572.2, 10.1, 10.33, 539.13, 340/539.1, 572.4, 10.3; 342/432, 463, 464, 342/450, 383, 373; 343/700 MS, 853
See application file for complete search history.

(56) References Cited

U.S. PATENT DOCUMENTS

| | | | | |
|---|---|---|---|---|
| 4,958,167 | A | 9/1990 | Schroeder | |
| 5,675,342 | A | 10/1997 | Sharpe | |
| 6,246,356 | B1 * | 6/2001 | Gunnarsson | 342/51 |
| 6,473,055 | B2 * | 10/2002 | Kohno et al. | 343/853 |
| 6,505,459 | B1 | 1/2003 | Ruohio et al. | |
| 6,696,923 | B2 * | 2/2004 | Ishii et al. | 340/10.2 |
| 6,717,516 | B2 * | 4/2004 | Bridgelall | 340/572.1 |
| 6,731,198 | B1 * | 5/2004 | Stobbe et al. | 340/10.33 |
| 7,038,584 | B2 * | 5/2006 | Carter | 340/539.13 |

FOREIGN PATENT DOCUMENTS

| | | |
|---|---|---|
| DE | 100 28 077 | 12/2001 |
| EP | 0 609 453 | 8/1994 |
| EP | 0 755 093 | 1/1997 |
| GB | 1 425 141 | 2/1976 |
| JP | 56-103502 | 8/1981 |
| JP | 2000-242742 | 9/2000 |
| JP | 2003-283367 | 10/2003 |

OTHER PUBLICATIONS

European Search Report dated Oct. 6, 2005.
Partial European Search Report dated Jun. 20, 2005.

* cited by examiner

*Primary Examiner*—Davetta W. Goins
(74) *Attorney, Agent, or Firm*—Katten Muchin Rosenman LLP

(57) ABSTRACT

The electronic tag authentication device of the present invention authenticates the contents of an electronic tag attached to goods. The electronic tag authentication device comprises an antenna directivity change unit for changing the directivity of an antenna for transmitting/receiving electrical waves in order to authenticate the contents of the electronic tag.

4 Claims, 14 Drawing Sheets

ELECTRONIC TAG AUTHENTICATION DEVICE AND COMMUNICATION ADJUSTMENT METHOD WITH ELECTRONIC TAG

BACKGROUND OF THE INVENTION

1. Field of the Invention

The present invention relates to the authentication method of an electronic tag attached to a goods, more particularly to provide an electronic tag authentication device capable of improving the authentication accuracy of an electronic tag and reducing interference with another electronic tag authentication device by changing the directivity of the antenna of the relevant electronic tag authentication device and a communication adjustment method with the electronic tag.

2. Description of the Related Art

Recently, in the fields of production and distribution, attention has been focused on a radio frequency identification (RFID) method as the management system of components or inventory. For example, if a different reader/writer is used for each showcase to manage goods with an electronic tags in a showcase, using such RFID, it causes a problem that the authentication accuracy of a tag degrades due to interference with another reader/writer or the like, although it depends on the disposition way of showcases.

As the prior arts concerning the data reading of such an electronic tag and an IC card, there are the following references.

Patent reference 1: Japanese Published Patent Application No. 2000-242742 "Interrogator System"

Patent reference 2: Japanese Published Patent Application No. 2003-283367 "Interrogator System"

Each of these references discloses a system interrogating a moving IC card, using a plurality of readers/writers. Patent Reference 1 discloses a technology for preventing the interference of a transmission signal between readers/writers by transmitting an interrogation signal when one reader/writer detects that a radio transmission signal from the other reader/writer is in a no-signal state.

Patent Reference 2 discloses a system for preventing interference caused when one reader/writer receives a transmission signal from the other reader/writer while expanding a communicable area, by overlapping and setting the communicable area of each of antennas corresponding to a plurality of readers/writers and synchronizing the transmission/reception of the plurality of reader/writers.

However, in the technology of Patent Reference 1, a plurality of readers/writers cannot be simultaneously operated. In order to solve the problem of the present invention aims to solve, a communicable area must be rather restricted. The technology of Patent Reference 2 cannot also be applied.

SUMMARY OF THE INVENTION

It is an object of the present invention to reduce interference between electronic tag authentication devices and to improve the reading/writing accuracy of a tag to be authenticated by each device when a plurality of electronic tag authentication devices are simultaneously used closely.

The electronic tag authentication device of the present invention authenticates the contents of an electronic tag attached to a goods, and comprises an antenna directivity change unit for changing the directivity of an antenna for transmitting/receiving electrical waves in order to authenticate the contents of the electronic tag.

DESCRIPTION OF THE PREFERRED EMBODIMENTS

Figure 1:
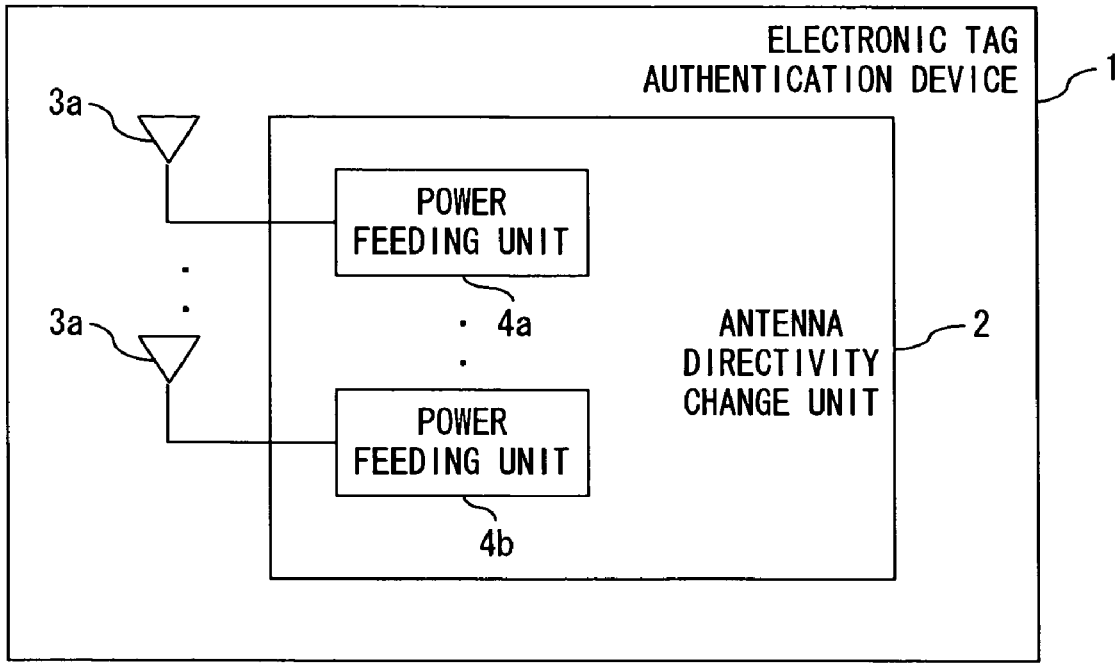
FIG. 1 is a block diagram showing the principle of the electronic tag authentication device of the present invention.

FIG. 1 is a block diagram showing the principle of the electronic tag authentication device of the present invention. FIG. 1 is a block diagram showing the principle of the electronic tag authentication device for authenticating the contents of an electronic tag attached to a goods. The authentication device 1 comprises an antenna directivity change unit 2 for changing the directivity of an antenna for radiating electrical waves in order to authenticate the contents of the electronic tag.

In this preferred embodiment of the present invention, an antenna is composed of a plurality of element antennas 3*a*, 3*b*, . . . , 3*n*. The antenna directivity change unit 2 can also comprise a plurality of power feeding units 4*a*, 4*b*, . . . , 4*n* capable of adjusting the amplitude and phase of a power feeding signal supplied to each element antenna, in accordance with the plurality of element antennas. In this case, a power feeding unit with desired directivity can be selected from the plurality of power feeding units whose influence on antenna directivity is known, by switching the plurality of power feeding units. In another preferred embodiment, the antenna can be composed of a plurality of element antennas, and an antenna directivity change unit 2 comprises a plurality of power feeding units capable of adjusting the amplitude and phase of a signal supplied to each of the plurality of element antennas, and a switching unit for changing the connection state between the plurality of power feeding units and the plurality of element antennas. In this case, each power feeding unit can also comprise a phase shifter which can be electrically controlled externally and a power divider. Alternatively, each power feeding unit can be composed of T-character type power feeding networks or hybrid type power feeding networks.

Then, in the present invention, a method for disposing a goods whose tag contents are known inside the boundary of the reading range of an electronic tag authentication device and changing the directivity of the antenna of the relevant authentication device in such a way that the known tag contents can be correctly read during the operation of another electronic tag authentication device whose reading target is a range adjacent to the above-mentioned reading range, is used as a communication adjustment method between an electronic tag attached to goods and an electronic tag authentication device.

According to the present invention, by changing the directivity of the antenna of an electronic tag authentication device and reading/writing an electronic tag, interference with another electronic tag authentication device can be reduced and the authentication accuracy of the electronic tag can be improved, which greatly contributes the performance improvement of goods management.

Figure 2:
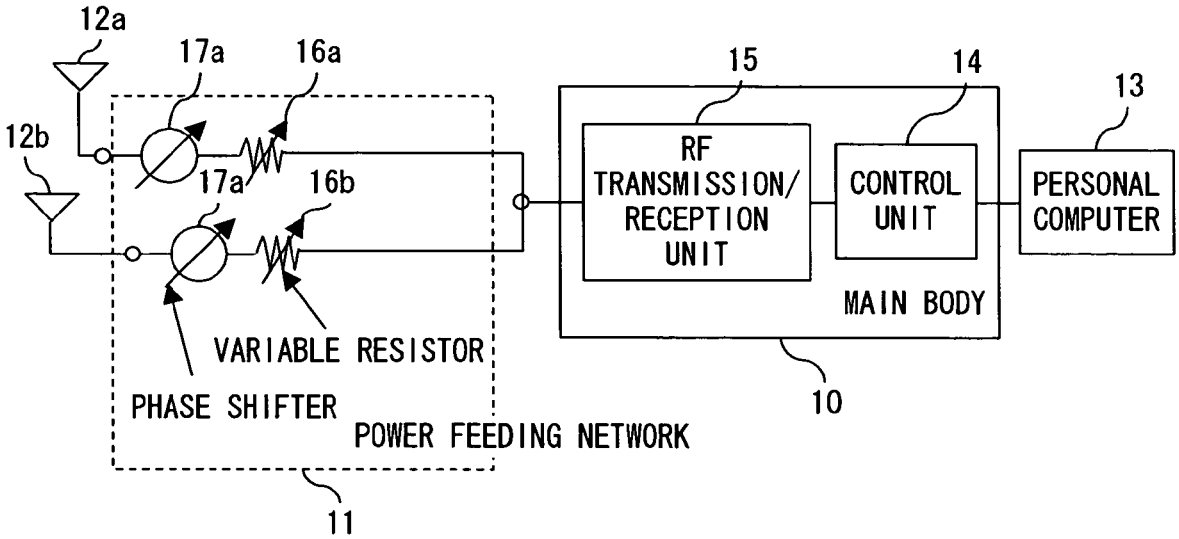
FIG. 2 is a block diagram showing the basic configuration of the electronic tag authentication device of the present invention.

FIG. 2 is a block diagram showing the basic configuration of the electronic tag authentication device of the present invention. In FIG. 2, an electronic tag authentication device corresponds to, for example, an RFID reader/writer for authenticating RFID attached to a goods. When reading/writing an electronic tag, the directivity of an antenna is similarly adjusted. For that reason, in the following description, the preferred embodiments of the present invention are described mainly on the reading of RFID as an electronic tag.

In FIG. 2, the electronic tag authentication device, such as an RFID reader/writer, comprises a main body 10, a power feeding network 11, a plurality of element antennas 12*a* and 12*b* and a personal computer 13. The main body 10 comprises a control unit 14 for controlling the authentication of RFID, an RF transmission/reception unit 15 for transmitting/receiving electronic waves by the antennas, a variable resistor 16*a* which is inserted between the RF transmission/reception unit 15 and each element antenna, for example, 12*a* and composes the power feeding network 11, a phase sifter 17*a* and the like.

In FIG. 2, by changing the resistance and phase of a variable resistor and phase sifter connected to the element antennas 12*a* and 12*b*, respectively, the amplitude and phase of a power feeding signal supplied to, for example, the element antenna 12*a* are changed. Then, the combined directivity of the antenna, composed of two element antennas 12*a* and 12*b* changes. Then, for example, interference with another adjacent reader/writer can be reduced and the authentication accuracy of RFID can be improved.

Figure 3:
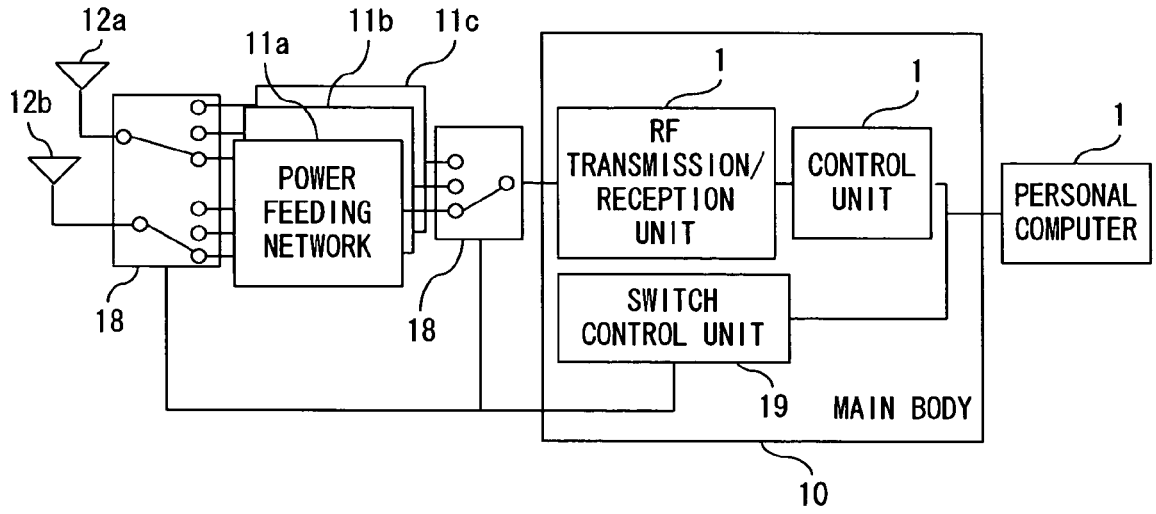
FIG. 3 is a block diagram showing the configuration of an RFID reader/writer for switching a plurality of power feeding networks.

FIG. 3 is a block diagram showing the configuration of an RFID reader/writer for switching a plurality of power feeding networks. In FIG. 3, a plurality of power feeding networks 11 is provided between an RF transmission/reception unit 15 and a plurality of element antennas 12*a* and 12*b*. A switching circuits 18 for switching the connection state of the plurality of power feeding networks 11 between the RF transmission/reception unit 15 and the element antennas 12*a* and 12*b*, and a switch control unit 19 for controlling the switching circuits 18 are also provided. Instead of switching the plurality of power feeding networks, for example, an appropriate one can also be selected from the power feeding networks whose influence on the combined directivity of the antenna is known.

Figure 4:
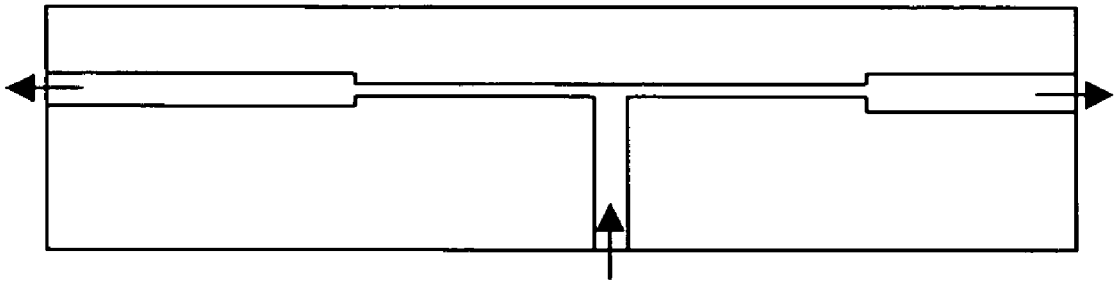
FIG. 4 explains a T-character type power feeding network.
Figure 5:
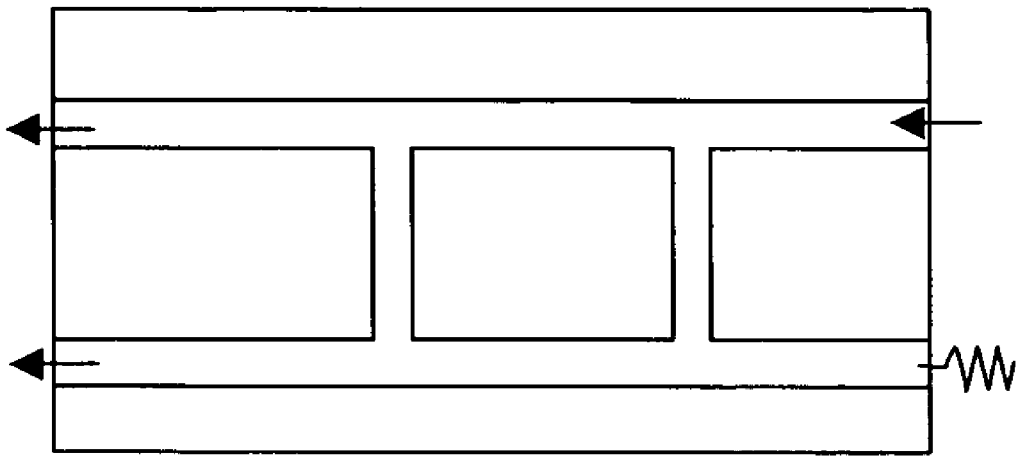
FIG. 5 explains a hybrid type power feeding network.

FIGS. 4 and 5 show the specific examples of the power feeding network 11 shown in FIG. 3. These are, for example, power feeding networks using a micro-strip pipeline. FIG. 4 shows a T-character type power feeding network, and FIG. 5 shows a hybrid type power feeding network. An input signal is branched into two output signals by these power feeding networks and is outputted. Depending on the structure of the micro-strip pipeline of the power feeding network, the amplitude of the two output signals can be changed. Alternatively, a phase difference can be generated between the two output signals.

For example, in the T-character type power feeding network shown in FIG. 4, an input signal is branched into the right and left sides and is transmitted through a narrow-width impedance conversion circuit. By changing the width of this line, the amplitude of a signal outputted to the right side and that of a signal outputted to the left side can be differentiated. For example, by making the width of the right side line narrower, the power of a signal, that is, its amplitude to be outputted on the right side can be reduced.

By differentiating the length of the broad part through which a signal is transmitted after the impedance conversion circuit, that is, a power feeding line between on the right and left sides, the phase difference between the two output signals can be changed to 90, 180 degrees or the like.

Figure 6:
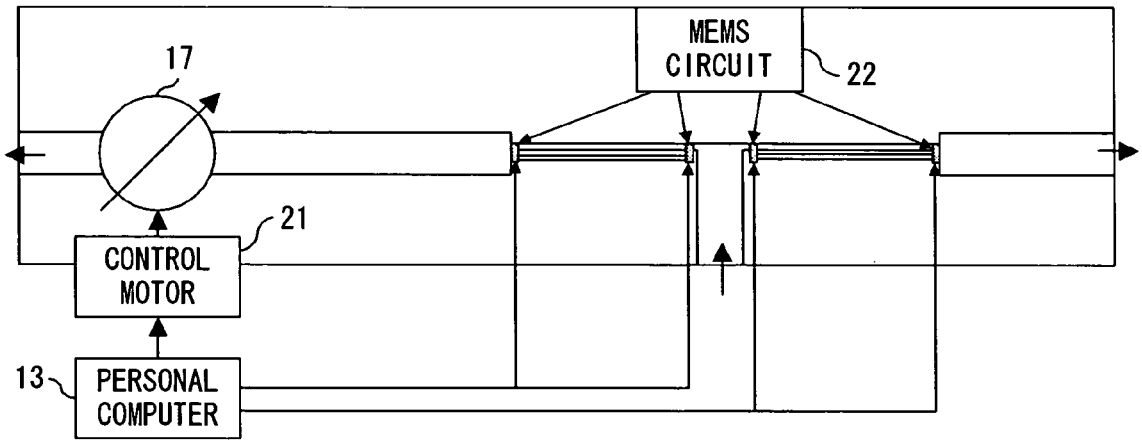
FIG. 6 explains a power feeding network provided with an electrically controlled phase shifter and a power divider.

FIG. 6 shows the configuration of a power feeding network provided with an electrically controlled phase shifter and a power divider. This power feeding network corresponds to the T-character type power feeding network shown in FIG. 4. A phase shift circuit 17 is provided for the power feeding line on the left side of the above-mentioned power feeding lines on the right and left sides. By a computer 13 controlling this phase shift circuit 17 through a control motor 21, the phase difference between the two output signals can be controlled.

In this case, the above-mentioned impedance conversion circuit is composed of two narrow-width micro-strip lines, and a minute mechanical switch is attached on each end of the impedance conversion circuit as a micro-electro-mechanical system (MEMS) circuit 22. By the computer 13 controlling the on/off of this switch, the width of the power feeding line can be changed, and the amplitude change of the two output signals can be controlled.

Figure 7:
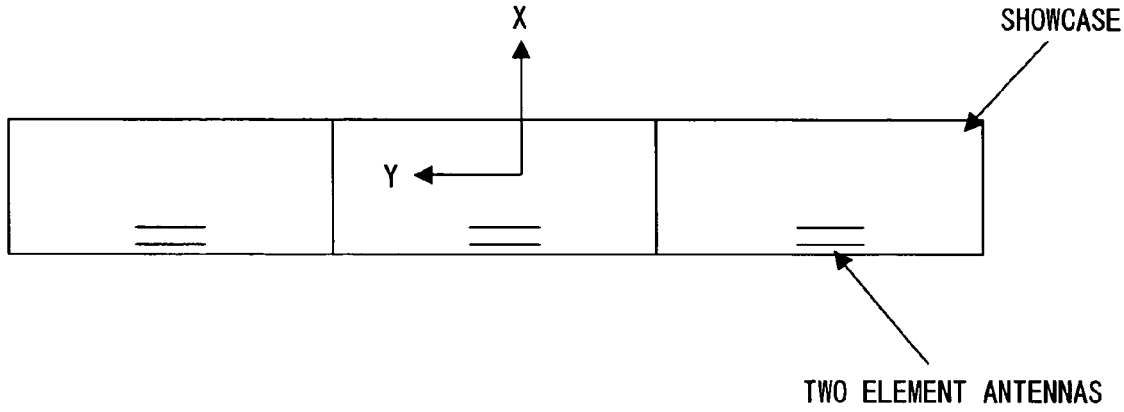
FIG. 7 shows the first example of showcase arrangement.
Figure 8:
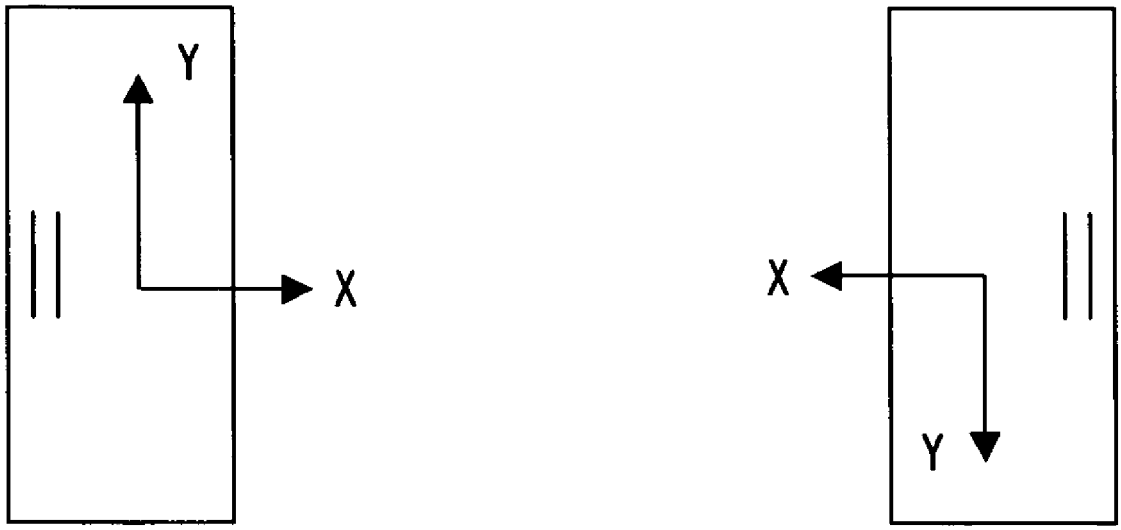
FIG. 8 shows the second example of showcase arrangement.
Figure 9:
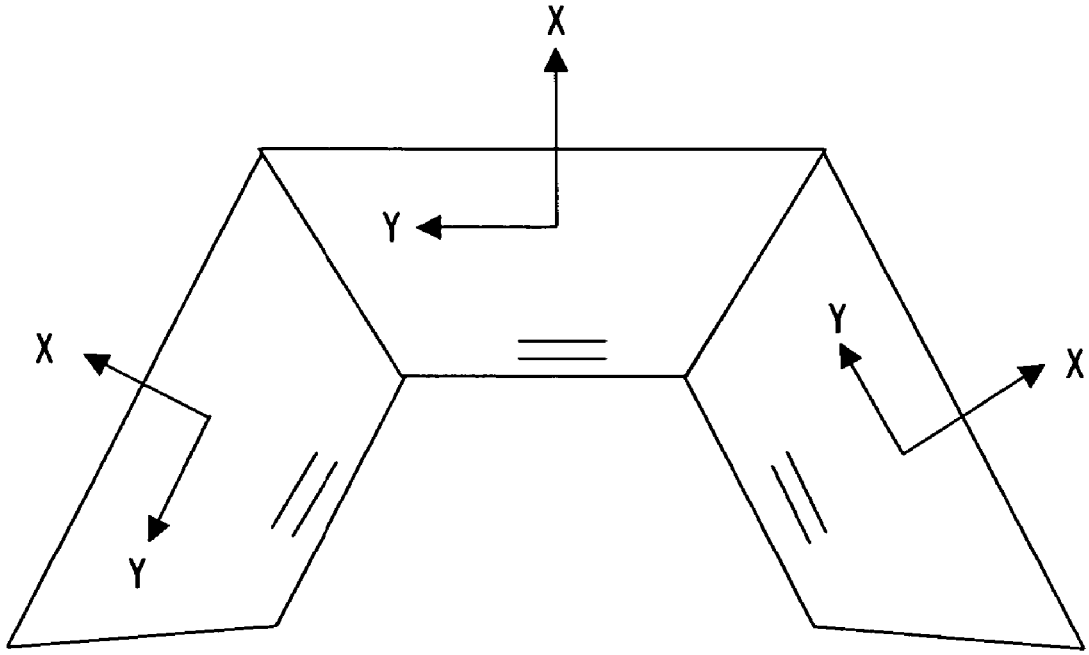
FIG. 9 shows the third example of showcase arrangement.

Next, the change of the directivity of an antenna connected to such an RFID reader/writer is described in connection with the disposition way of showcases. FIGS. 7 through 9 show examples of the showcase disposition way. In the first disposition way shown in FIG. 7, three showcases are disposed in a horizontal line, and the RFID contents of a goods with RFID attached are authenticated using two element antennas. In this case, the two element antennas are, for example, the element antennas 12*a* and 12*b* shown in FIG. 3, and each element antenna is wired to the power feeding network 11.

For example, even if another RFID reader/writer reads the RFID of a goods in the showcase on the right side when the relevant RFID reader/writer reads a goods in the center showcase, interference between the two readers/writers must be reduced as much as possible to improve the accuracy of RFID reading. In the first disposition way, it is assumed that a salesperson who sells a goods and a customer who wants to buy a goods are positioned on the lower and upper sides, respectively, and that the salesperson reads RFID on the side close to the two element antennas located in the showcase.

FIG. 8 shows the second disposition way of showcases. In FIG. 8, it is assumed that the customer is positioned in a wide range between two showcases and that the salesperson is positioned outside each of the showcases and reads RFID in a position close to two element antennas.

In the third disposition way shown in FIG. 9, it is assumed that the salesperson reads RFID inside three showcases and that the customer is positioned outside the showcases. The X- and Y-axes in these three dispositions correspond to axes for determining an XY plane indicating combined directivity, which is described later.

Figure 10:
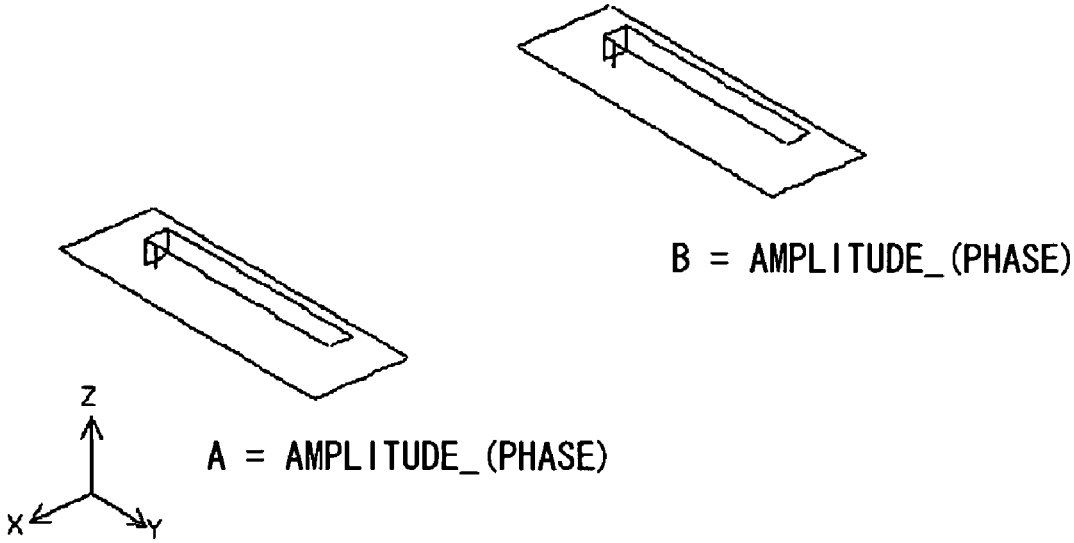
FIG. 10 shows two element antennas disposed in a showcase arrangement.

FIG. 10 shows two element antennas disposed in each showcase. These two element antennas are composed of, for example, inverted F antenna elements. The two element antennas are installed in a position away from each other by the half wavelength of an electrical wave to be used to authenticate RFID. A and B shown in FIG. 10 are used to explain the relationship between the amplitude and phase of a power feeding signal supplied to two element antennas with reference to the combined directivity shown in FIGS. 11 through 13.

Figure 11:
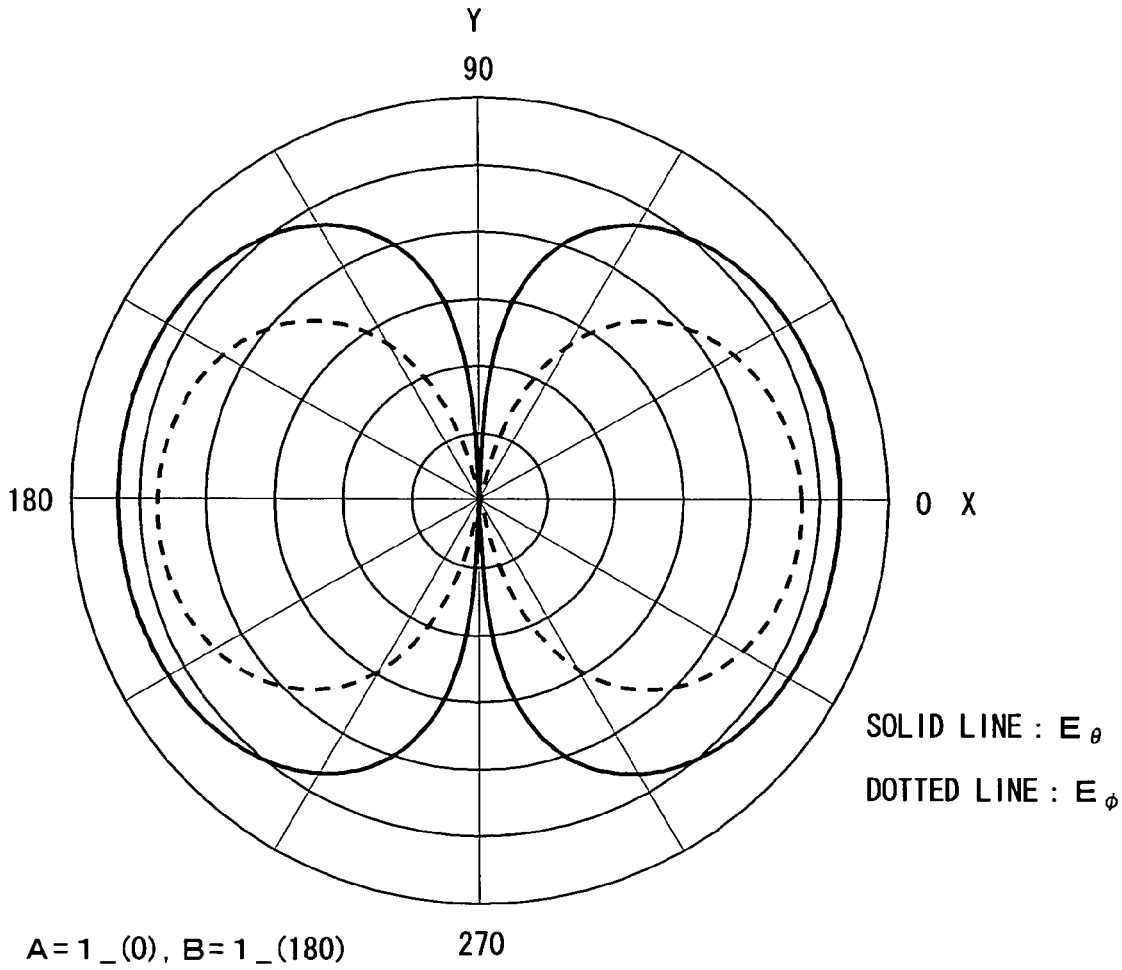
FIG. 11 shows the combined directivity of antennas shown in FIG. 7.

FIG. 11 shows the combined directivity of antennas corresponding to the first showcase disposition way shown in FIG. 7. In FIG. 11, a solid line and a dotted line indicate electrical field factors Eθ and Eϕ, respectively, corresponding to an angle (direction) in the case where a distance from the origin is constant. In this case, θ and ϕ correspond to the coordinates of a sphere coordinate system. This combined directivity indicates a distant solution.

In FIG. 11, respective amplitude against A and B both are 1, and the respective amplitude of a power feeding signal, supplied to two element antennas are the same. However, phase against A and B are 0 and 180 degrees, respectively. In other words, the phase of a power feeding signal supplied to an element antenna on the B side advances by 180 degrees, compared with that of a power feeding signal supplied to an antenna on the A side.

If in FIG. 11, the showcase disposition way shown in FIG. 7 is studied, the size of an electrical field vector is almost 0 in the direction of the adjacent showcases, that is, in the Y-axis direction. In another words, by pointing NULL to the Y-axis direction, interference between the RFID readers/writers in the adjacent showcases can be reduced.

Figure 12:
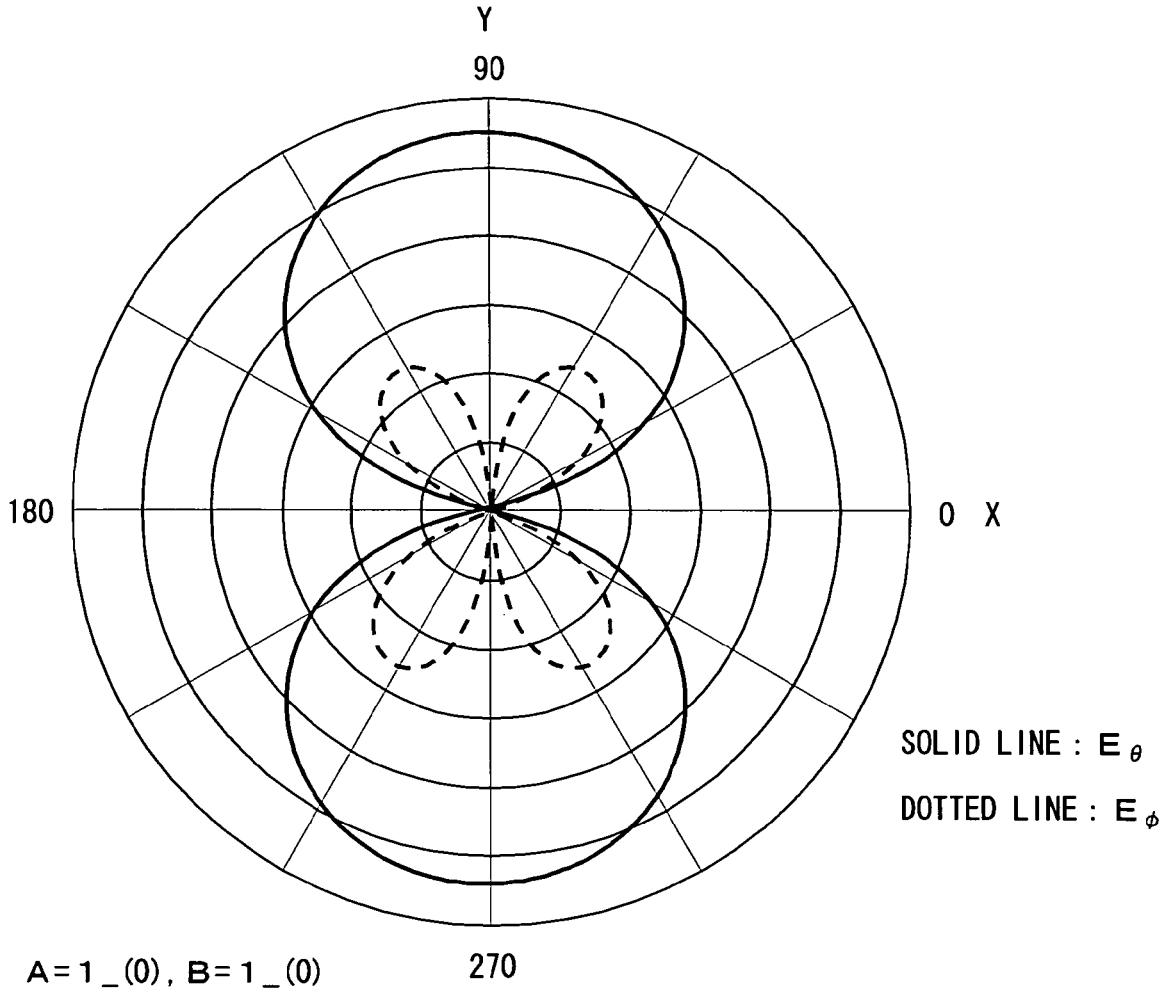
FIG. 12 shows the combined directivity of antennas shown in FIG. 8.

FIG. 12 shows the combined directivity of antennas corresponding to the second showcase disposition way shown in FIG. 8. In FIG. 12, the respective amplitude of a power feeding signal supplied to two element antennas are the same and their phase difference is 0. However, in this state, the NULL of directivity is pointed to the X-axis direction, that is, the opposite showcase. Thus, interference between the RFID readers/writers on the RFID of goods in the two showcases can be reduced.

Figure 13:
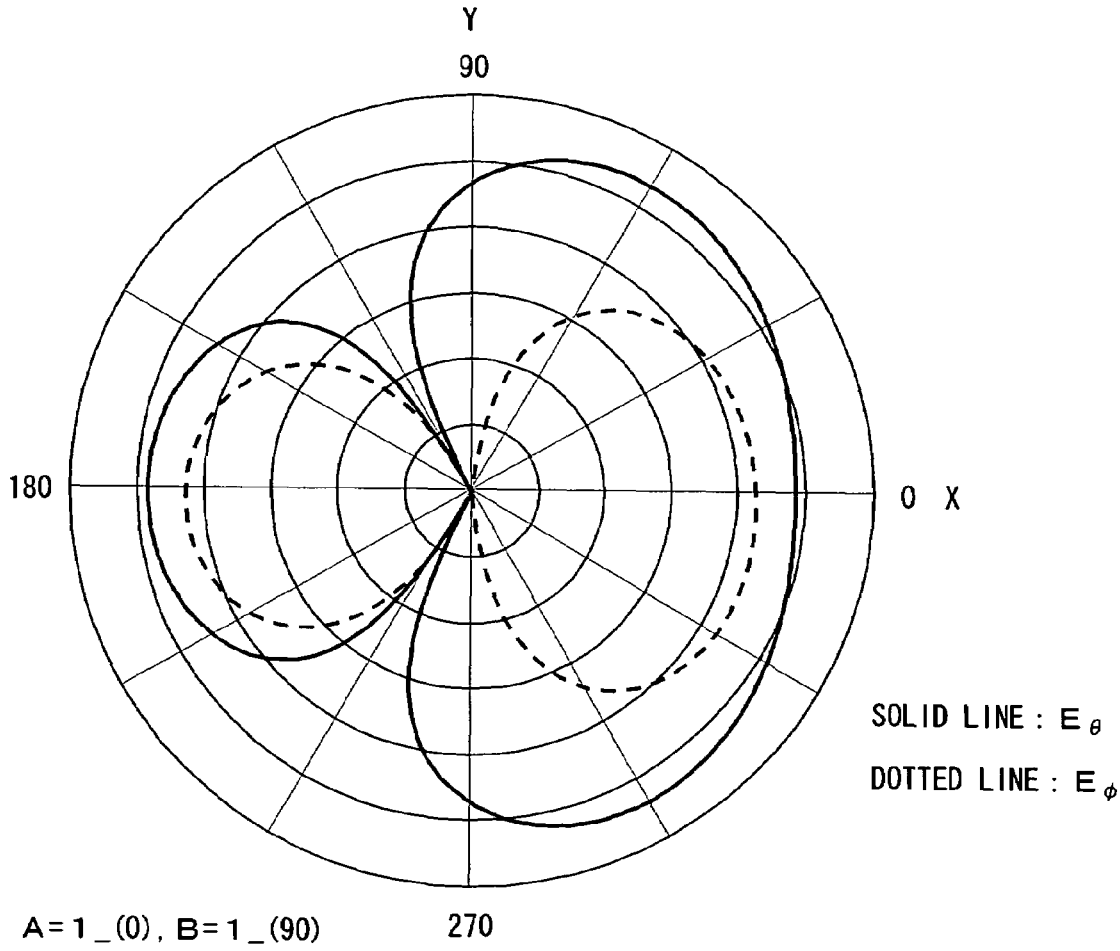
FIG. 13 shows the combined directivity of antennas shown in FIG. 9.

FIG. 13 shows the combined directivity of antennas corresponding to the third showcase disposition way shown in FIG. 9. In FIG. 13, the electrical field vector value is maintained fairly large in the range of ±90 degrees using the X-axis as the center, and the RFID of a goods in each showcase can be correctly read. For example, by adjusting the amplitude of a power feeding signal, the reading range of RFID can also be limited to the inside of each showcase. In FIG. 13, the respective amplitude of a power feeding signal supplied to two element antennas are the same, and their phase difference is 90 degrees.

Figure 14:
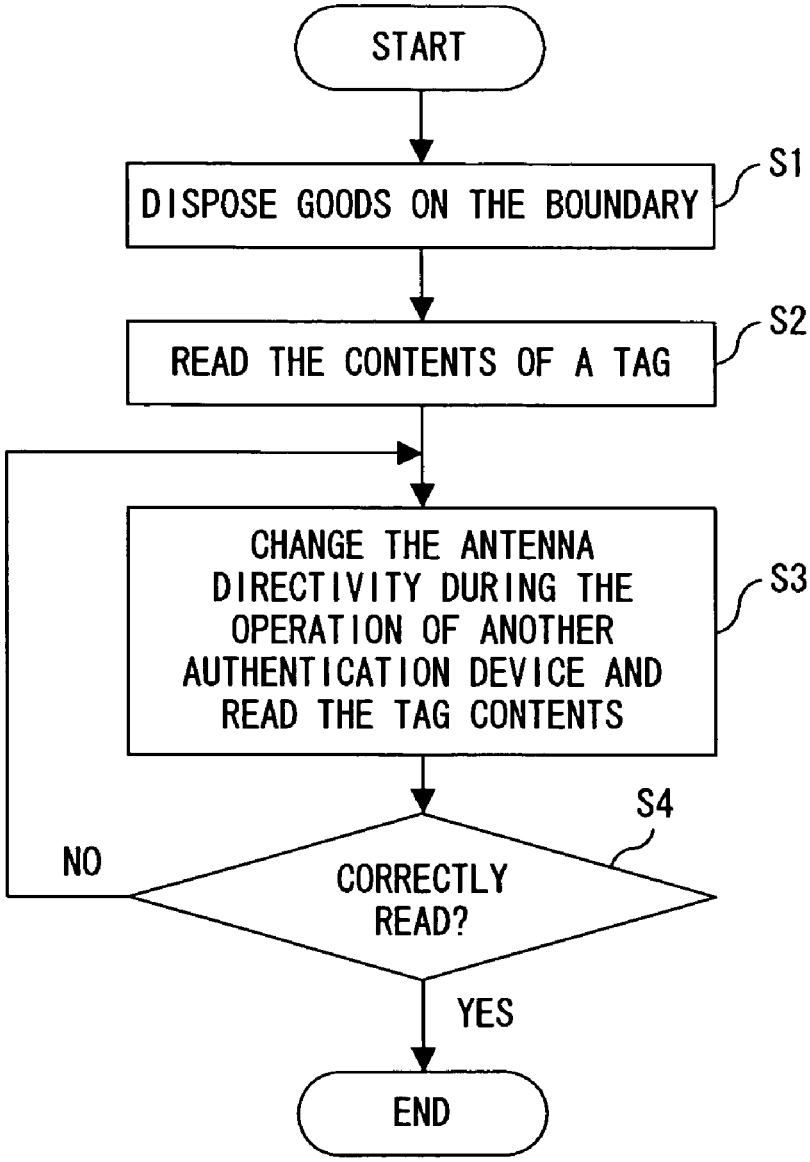
FIG. 14 is a flowchart showing the communication adjustment method with an electronic tag attached.

FIG. 14 is a flowchart showing the communication adjustment method with an electronic tag in this preferred embodiment. In this preferred embodiment, communication with an electronic tag can be adjusted, for example, by disposing a goods whose RFID value is known close to the boundary with an adjacent showcase of the above-mentioned showcase and adjusting the directivity of an antenna in such a way that its contents can be correctly read.

When in FIG. 14, an adjustment operation is started, firstly, in step S1, as described above, a goods whose electronic tag contents is known is disposed inside the boundary of a tag reading range. Then, in step S2, the contents of a tag are read. In this case, it is assumed that the read contents of the tag coincide with the known contents.

Then, in step S3, for example, the antenna directivity of the relevant reader/writer is adjusted during the operation of another RFID reader/writer corresponding to an adjacent showcase, and the contents of an electronic tag, that is, RFID are read. Then, in step S4, it is determined whether the read contents are correct. If the contents are not correct, the process returns to step S3, and in step S3, both the adjustment of antenna directivity and reading of another tag contents are performed. If in step S4, it is determined that the read result is correct, the operation is terminated.

What is claimed is:

1. An electronic tag authentication device, comprising:

an antenna directivity change unit for changing a directivity of an antenna for transmitting/receiving electrical waves in order to authenticate contents of an electronic tag attached to goods, wherein said antenna comprises a plurality of element antennas; and said antenna directivity change unit comprises, in accordance with the plurality of element antennas:

a plurality of power feeding units capable of adjusting the amplitude and phase of a power feeding signal supplied to each element antenna; and a switching unit for changing the connection state between the plurality of power feeding units and the plurality of element antennas, said power feeding units each comprise a phase shifter electrically controlled externally and a power divider, said phase shifter is controlled by a computer through a control motor, and said power divider comprises an impedance conversion unit controlled by a computer through a micro-electro-mechanical system unit.

2. The electronic tag authentication device according to claim 1, wherein said power feeding unit is composed of T-character type power feeding network.

3. The electronic tag authentication device according to claim 1, wherein said power feeding unit is composed of hybrid type power feeding network.

4. An adjustment method of communication between an electronic tag attached to goods and an electronic tag authentication device according to claim 1, the method comprising:

disposing goods whose tag content is known, inside a boundary of a reading range of an electronic tag authentication device; and changing the directivity of the antenna of the relevant electronic tag authentication device in such a way that the known tag contents can be correctly read during an operation of another electronic tag authentication device whose reading target is a range adjacent to said reading range.

* * * * *